US008907583B1

(12) United States Patent
Huang et al.

(10) Patent No.: US 8,907,583 B1
(45) Date of Patent: Dec. 9, 2014

(54) LED DRIVING DEVICE

(71) Applicant: Richtek Technology Corp., Hsinchu County (TW)

(72) Inventors: Chih-Feng Huang, Hsinchu County (TW); Kuo-Chin Chiu, Hsinchu County (TW)

(73) Assignee: Richtek Technology Corp., Zhubei, Hsinchu County (TW)

( * ) Notice: Subject to any disclaimer, the term of this patent is extended or adjusted under 35 U.S.C. 154(b) by 0 days.

(21) Appl. No.: 14/066,268

(22) Filed: Oct. 29, 2013

(30) Foreign Application Priority Data

May 29, 2013 (TW) ..... 102118966 A

(51) Int. Cl.
*H05B 33/08* (2006.01)

(52) U.S. Cl.
CPC ..... *H05B 33/0821* (2013.01); *H05B 33/0824* (2013.01)
USPC ..... 315/224; 315/185 R; 315/307

(58) Field of Classification Search
USPC ..... 315/291, 307, 308, 224, 185 R, 191
See application file for complete search history.

(56) References Cited

U.S. PATENT DOCUMENTS

| | | | | |
|---|---|---|---|---|
| 7,081,722 | B1 | 7/2006 | Huynh et al. | |
| 8,598,796 | B2 * | 12/2013 | Jeong | 315/192 |
| 2013/0155561 | A1 * | 6/2013 | Lai | 361/91.5 |
| 2013/0257299 | A1 * | 10/2013 | Fujimoto | 315/186 |

* cited by examiner

*Primary Examiner* — David H Vu
(74) *Attorney, Agent, or Firm* — Osha Liang LLP

(57) ABSTRACT

An LED driving device includes: a rectifying circuit for outputting a DC voltage to a string of M LED units; (M−1) first switching circuits each coupled between a corresponding one of first to $(M-1)^{th}$ LED units and ground; and a second switching circuit coupled between an $M^{th}$ LED unit and ground. When the DC voltage is sufficient to turn on first to $k^{th}$ LED units, where $1 \le k \le M$, the $k^{th}$ LED unit is coupled to ground through first and second conductive paths provided by a resistor unit, and a corresponding first switching circuit or the second switching circuit, and each of the first to $(k-1)^{th}$ LED units is coupled to ground through a third conductive path provided by a corresponding first switching circuit and the resistor unit.

12 Claims, 12 Drawing Sheets

LED DRIVING DEVICE

CROSS-REFERENCE TO RELATED APPLICATION

This application claims priority to Taiwanese Application No. 102118966, filed on May 29, 2013, the contents of which are hereby incorporated by reference.

BACKGROUND OF THE INVENTION

1. Field of the Invention

The invention relates to a driving device, and more particularly to a light emitting diode (LED) driving device.

2. Description of the Related Art

FIG. 1 illustrates a conventional LED driving device 1 disclosed in U.S. Pat. No. 7,081,722. The conventional LED driving device 1 is used to drive a plurality of series connected LED units 10, each of which includes an LED. The conventional LED driving device 1 includes a rectifier 11 for rectifying an AC voltage from an AC power source (Vin) to a DC voltage (Vrec), a voltage generator 12 for generating a reference voltage (Vref), a plurality of switches (S1~S4), a plurality of operational amplifiers (OP1~OP4), and a plurality of resistors (R1~R16).

In operation, initially, the DC voltage (Vrec) is not sufficient to turn on a first LED unit 10, and each of the first to fourth switches (S1~S4) conduct in response to an output signal from a respective one of the operational amplifiers (OP1~Op4). Then, when the DC voltage (Vrec) increases enough to turn on the first LED unit 10, the first to fourth switches (S1~S4) still conduct such that a current flows through the first switch (S1) and the resistor (R1). When the DC voltage (Vrec) increases enough to turn on the first and second LED units 10, the operational amplifier (OP1) senses this condition by monitoring through the resistors (R3, R4) a potential (V2) at a common node between the second and third LED units 10, and turns off the first switch (S1). At the same time, the second to fourth switches (S2~S4) still conduct such that a current flows through the resistor (R5) and the second switch (S2). Similarly, when the DC voltage (Vrec) increases enough to turn on the first to third LED units 10, the operational amplifier (OP2) senses this condition by monitoring a potential (V3) at a common node between the third and fourth LED units 10, and turns off the second switch (S2). When the DC voltage (Vrec) increases enough to turn on all of the LED units 10, the operational amplifier (OP3) senses this condition by monitoring a potential (V4) at one end of the fourth LED unit 10 distal from the third LED unit 10, and turns off the third switch (S3).

In such a configuration, the operational amplifiers (OP1~OP4) serve as essential components to control operations of the first to fourth switches (S1~S4). In addition, if the configuration of one LED unit 10 varies, for example, variation in the number or type of LEDs thereof, the reference voltage (Vref) generated by the voltage generator 12 must be adjusted accordingly.

SUMMARY OF THE INVENTION

Therefore, an object of the present invention is to provide an LED driving device that can overcome the aforesaid drawbacks of the prior art.

According to the present invention, there is provided an LED driving device for driving a number (M) of LED units coupled in series. Each of the LED units has an input end and an output end. The LED driving device comprises:

a rectifying circuit adapted to be coupled between an alternating current (AC) power source and the input end of a first one of the LED units for receiving an AC input voltage from the AC power source, and rectifying the AC input voltage to a direct current (DC) voltage;

a number (M−1) of first switching circuits, each of which is adapted to be coupled between the output end of a corresponding one of first to $(M-1)^{th}$ ones of the LED units and ground;

a second switching circuit adapted to be coupled between the output end of an $M^{th}$ one of the LED units and ground; and a resistor unit coupled among the first switching circuits, the second switching circuit and ground.

When the DC voltage from the rectifying circuit is sufficient to turn on the first to $k^{th}$ ones of the LED units, in which k is a positive integer ranging from 1 to M, a $k^{th}$ one of the LED units is coupled to ground through first and second conductive paths, which are provided by a $k^{th}$ one of the first switching circuits and the resistor unit if $1 \le k \le M-1$, or by the second switching circuit and the resistor unit if k=M, and each of first to $(k-1)^{th}$ ones of the LED units is coupled to ground through a third conductive path, which is provided by a corresponding one of first to $(k-1)^{th}$ ones of the first switching circuits, and the resistor unit if $2 \le k \le M$.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
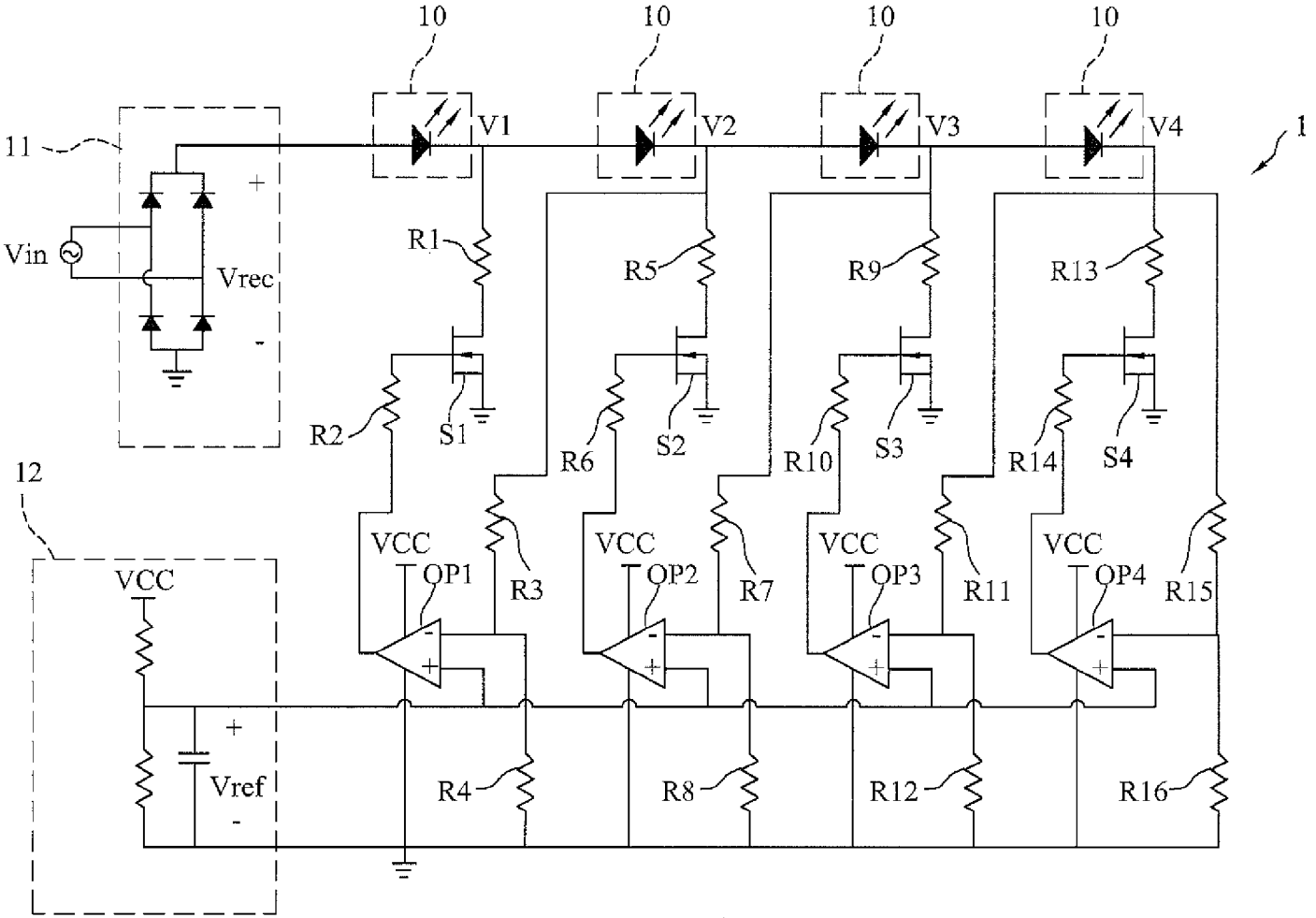
FIG.1 PRIOR ART
FIG. 1 is a schematic electrical circuit diagram illustrating a conventional LED driving device.

Before the present invention is described in greater detail, it should be noted that like elements are denoted by the same reference numerals throughout the disclosure.

Figure 2:
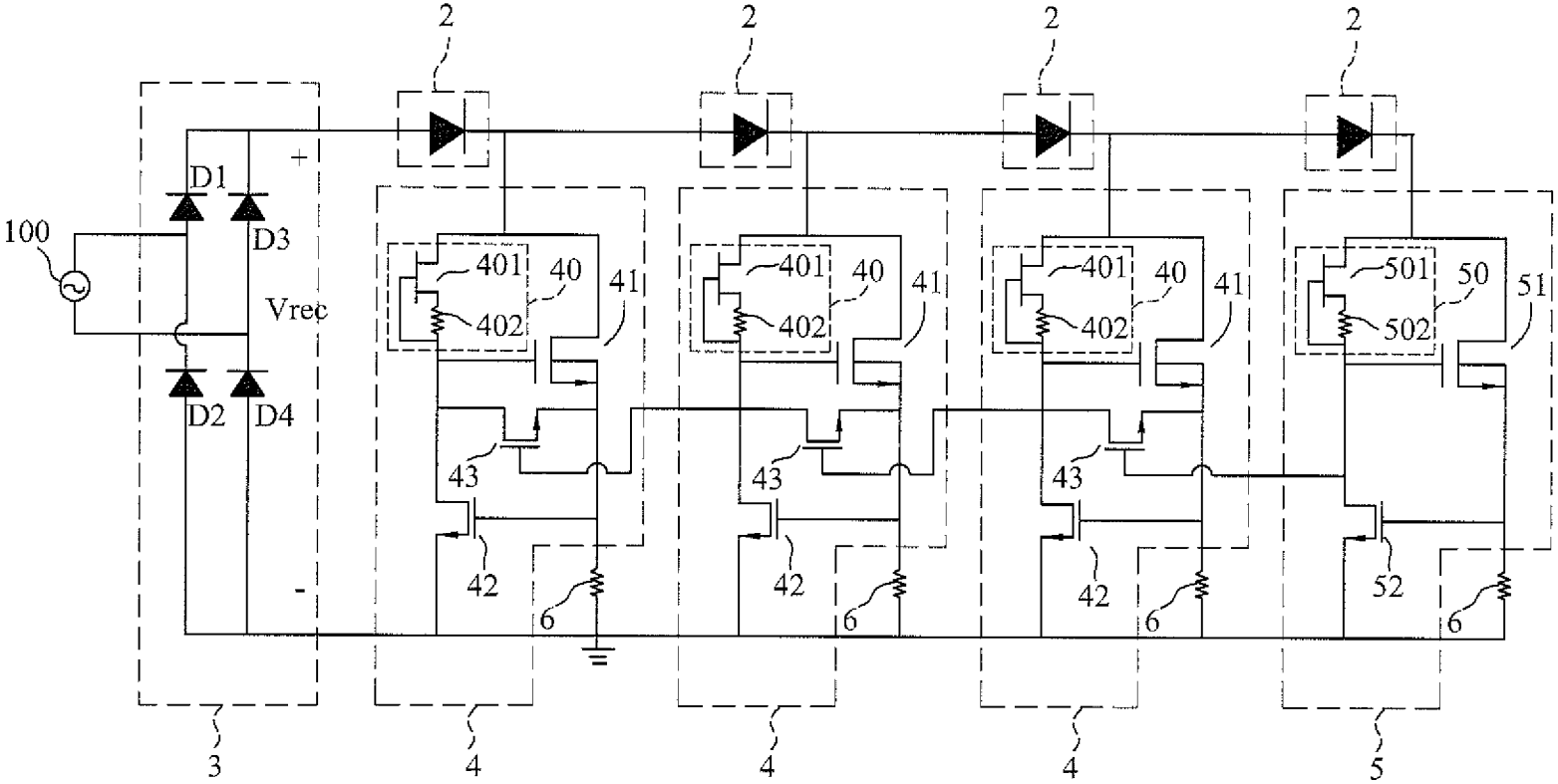
FIG. 2 is a schematic electrical circuit diagram illustrating the first preferred embodiment of an LED driving device according to the present invention.

Referring to FIG. 2, the first preferred embodiment of an LED driving device according to the present invention is adapted to drive a number (M) of LED units 2 coupled in series. Each LED unit 2 has an input end and an output end. In this embodiment, M=4, and each LED unit 2 includes, but is not limited to, an LED whose anode and cathode serve respectively as the input and output ends of the LED unit 2. The LED driving device includes a rectifying circuit 3, three (i.e., M−1) first switching circuits 4, a second switching circuit 5, and a resistor unit.

The rectifying circuit 3 is adapted to be coupled between an alternating current (AC) power source 100 and the input end of a first LED unit 2 for receiving an AC input voltage from the AC power source 100. The rectifying circuit 3 rectifies the AC input voltage to a direct current (DC) voltage (Vrec), which is applied to the input end of the first LED unit 2. In this embodiment, the rectifying circuit 3 includes a full-bridge rectifier, which consists of four diodes (D1~D4).

Each first switching circuit 4 is coupled between the output end of a corresponding one of the first to third LED units 2, and includes an impedance unit 40, and first to third switches 41, 42, 43.

For an $i^{th}$ first switching circuit 4, where $1 \leq i \leq 3(=M-1)$, the impedance unit 40 has a first end coupled to the output end of an $i^{th}$ LED unit 2, and a second end. The first switch 41 has a first end coupled to the first end of the impedance unit 40, a second end coupled to the resistor unit, and a control end coupled to the second end of the impedance unit 40. The second switch 42 has a first end coupled to the second end of the impedance unit 40, a grounded second end, and a control end coupled to the second end of the first switch 41. The third switch 43 has a first end coupled to the second end of the impedance unit 40, a second end coupled to the second end of the first switch 41, and a control end coupled to the second end of the impedance unit 40 of an $(i+1)^{th}$ first switching circuit 4 if $1 \leq i \leq 2(=M-2)$. Each of the first to third switches 41, 42, 43 is, but is not limited to, an N-type metal oxide semiconductor field effect transistor (MOSFET), which has a drain, a source and a gate serving respectively as the first, second and control ends thereof.

The second switching circuit 5 is adapted to be coupled between the output end of the fourth LED unit 2 and ground, and includes an impedance unit 50, a first switch 51 and a second switch 52. The impedance unit 50 has a first end that is adapted to be coupled to the output end of the fourth LED unit 2, and a second end that is coupled to the control end of a third one (i.e., $(M-1)^{th}$) of the first switching circuits 4. The first switch 51 has a first end coupled to the first end of the impedance unit 50, a second end coupled to the resistor unit, and a control end coupled to the second end of the impedance unit 50. The second switch 52 has a first end coupled to the second end of the impedance unit 50, a grounded second end, and a control end coupled to the second end of the first switch 51. Similar to the first and second switches 41, 42 of each first switching circuit 4, each of the first and second switches 51, 52 is, but is not limited to, an N-type MOSFET, which has a drain, a source and a gate serving respectively as the first, second and control ends thereof.

The resistor unit is coupled among the first switching circuits 4, the second switching circuit 5 and ground. In this embodiment, the resistor unit includes four first resistors 6, a $j^{th}$ one of which is coupled between the second end of the first switch 41 of a $j^{th}$ one of the first switching circuits 4 and ground if $1 \leq j \leq 3$ or between the second end of the first switch 51 of the second switching circuit 5 and ground if j=4.

It is noted that the impedance unit 40, 50 of each of the first switching circuits 4 and the second switching circuit 5 has an impedance much larger than that of each first resistor 6. In this embodiment, for each of the first switching circuits 4 and the second switching circuit 5, the impedance unit 40, 50 includes a transistor 401, 501 and a second resistor 402, 502 coupled to each other in series and coupled respectively to the first and second ends of the impedance unit 40, 50. The transistor 401, 501 has a control end coupled to the second end of the impedance unit 40, 50. In this case, the transistor 401, 501 normally conducts. The transistor 401, 501 is an N-type junction field effect transistor (JFET), which has a drain serving as the first end of the impedance unit 40, 50, a gate serving as the control end thereof, and a source coupled to one end of the second resistor 402, 502. The other end of the second resistor 402, 502 serves as the second end of the impedance unit 40, 50. The second resistor 402, 502 has a resistance much larger than that of each first resistor 6.

Figure 3:
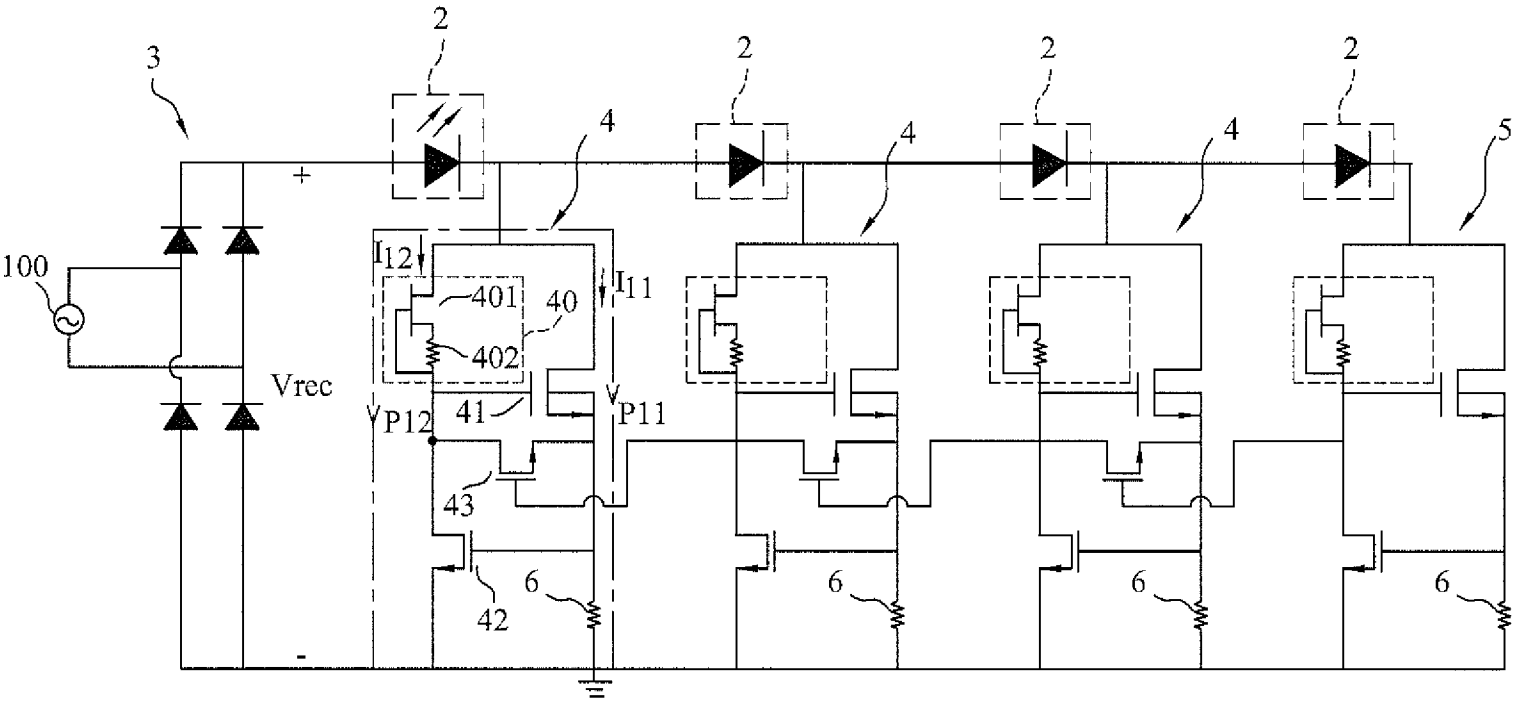
FIGS. 3 to 6 are schematic electrical circuit diagrams illustrating the first preferred embodiment when operating in first to fourth driving states, respectively.

In use, the LED driving device is operable among first to fourth driving states. Referring to FIG. 3, when the DC voltage (Vrec) is sufficient to turn on the first LED unit 2, the LED driving device operates in the first driving state. In the first driving state, the first and second switches 41, 42 of a first one of the first switching circuits 4 conduct while the third switch 43 of the same does not conduct. Thus, the first switch 41 of the first one of the first switching circuits 4 and a first one of the first resistors 6 of the resistor unit constitute a first conductive path (P11). The impedance unit 40 and the second switch 42 of the first one of the first switching circuits 4 constitute a second conductive path (P12). Therefore, the output end of the first LED unit 2 is coupled to ground through the first and second conductive paths (P11, P12). In this case, the first one of the first switching circuits 4 permits a first current ($I_{11}$) to flow from the output end of the first LED unit 2 to ground through the first conductive path (P11), and permits a second current ($I_{12}$) to flow from the output end of the first LED unit 2 to ground through the second conductive path (P12). As a result, the first LED unit 2 is driven to emit light during the first driving state of the LED driving device. It is noted that, since the impedance of the impedance unit 40 of each first switching circuit 4 is much larger than that of each first resistor 6, the first current ($I_{11}$) is much greater than the second current ($I_{12}$).

Figure 4:
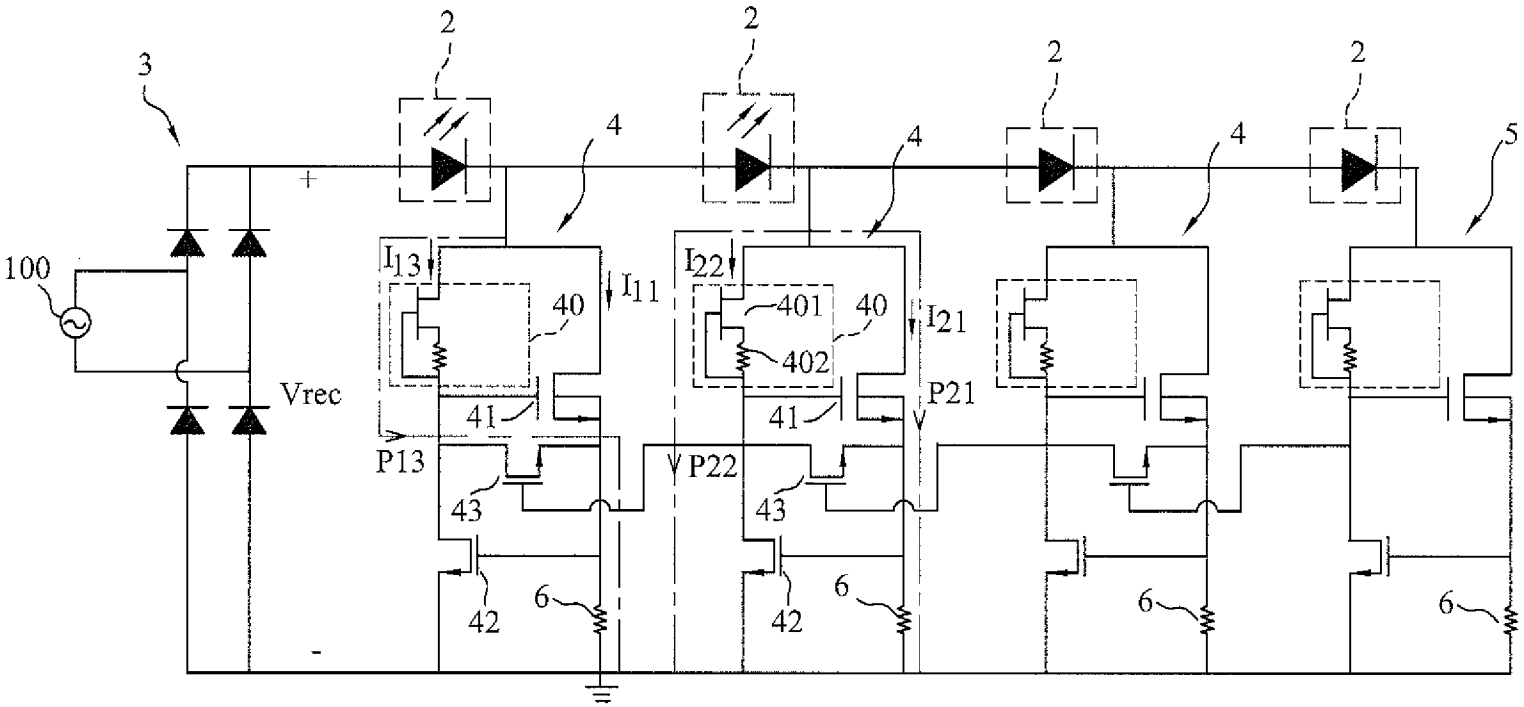

Referring to FIG. 4, when the DC voltage (Vrec) is sufficient to turn on the first and second LED units 2, the LED driving device operates in the second driving state. In the second driving state, the first and second switches 41, 42 of a second one of the first switching circuits 4 conduct while the third switch 43 of the same does not conduct. In addition, the first and second switches 41, 42 of the first one of the first switching circuits 4 do not conduct, and the third switch 43 of the same conducts. Thus, the first switch 41 of the second one of the first switching circuits 4 and a second one of the first resistors 6 of the resistor unit constitute a first conductive path (P21). The impedance unit 40 and the second switch 42 of the second one of the first switching circuits 4 constitute a second conductive path (P22). Therefore, the output end of the second LED unit 2 is coupled to ground through the first and second conductive paths (P21, P22). Meanwhile, the impedance unit 40 and the third switch 43 of the first one of the first switching circuits 4 and the first one of the first resistors 6 constitute a third conductive path (P13). Therefore, the output end of the first LED unit 2 is coupled to ground through the third conductive path (P13). In this case, the first one of the first switching circuits 4 permits a third current ($I_{13}$) to flow from the output end of the first LED unit 2 to ground through the third conductive path (P13). The second one of the first switching circuit 4 permits a first current ($I_{21}$) to flow from the output end of the second LED unit 2 to ground through the first conductive path (P21), and permits a second current ($I_{22}$) to flow from the output end of the second LED unit 2 to ground through the second conductive path (P22). As a result, the first and second LED units 2 are driven to emit light during the second driving state of the LED driving device. It is noted that, since the impedance of the impedance unit 40 of each first switching circuit 4 is much larger than that of each first resistor 6, the first current ($I_{21}$) is much greater than the second current ($I_{22}$) and the third current ($I_{13}$).

Figure 5:
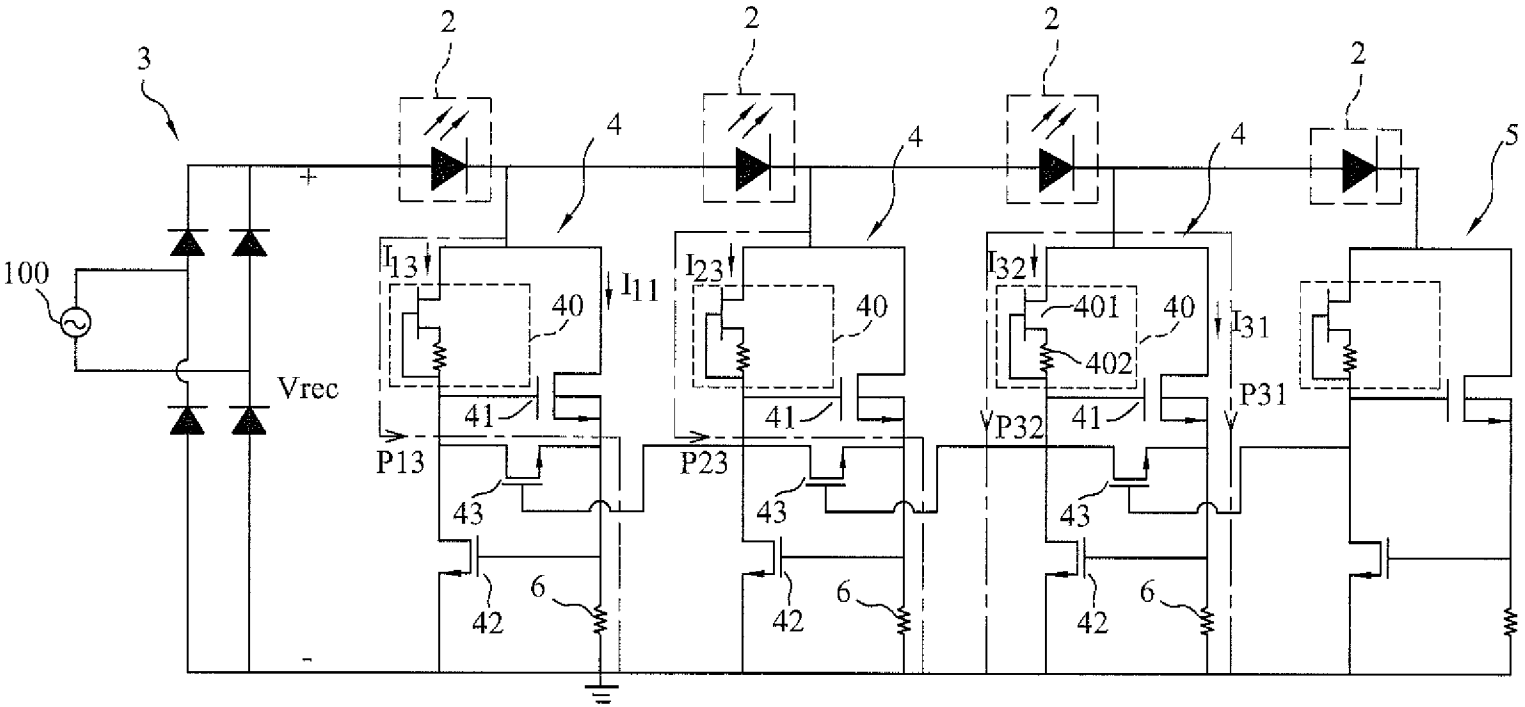

Referring to FIG. 5, when the DC voltage (Vrec) is sufficient to turn on the first to third LED units 2, the LED driving device operates in the third driving state. In the third driving state, the first and second switches 41, 42 of a third one of the first switching circuits 4 conduct while the third switch 43 of the same does not conduct. In addition, the first and second switches 41, 42 of each of the first and second ones of the first switching circuits 4 do not conduct, and the third switch 43 of the same conducts. Thus, the first switch 41 of the third one of the first switching circuits 4 and a third one of the first resistors 6 of the resistor unit constitute a first conductive path (P31). The impedance unit 40 and the second switch 42 of the third one of the first switching circuits 4 constitute a second conductive path (P32). Therefore, the output end of the third LED unit 2 is coupled to ground through the first and second conductive paths (P31, P32). Meanwhile, in addition to the third conductive path (P13) provided for the first LED unit 2, the impedance unit 40 and the third switch 43 of the second one of the first switching circuits 4 and the second one of the first resistors 6 constitute another third conductive path (P23) provided for the second LED unit 2. Therefore, the output end of each of the first and second LED units 2 is coupled to ground through a respective one of the third conductive paths (P13, P23). In this case, the first one of the first switching circuits 4 permits the third current ($I_{13}$) to flow from the output end of the first LED unit 2 to ground through the third conductive path (P13). The second one of the first switching circuits 4 permits the third current ($I_{23}$) to flow from the output end of the second LED unit 2 to ground through the third conductive path (P23). The third one of the first switching circuit 4 permits a first current ($I_{31}$) to flow from the output end of the third LED unit 2 to ground through the first conductive path (P31), and permits a second current ($I_{32}$) to flow from the output end of the third LED unit 2 to ground through the second conductive path (P32). As a result, the first to third LED units 2 are driven to emit light during the third driving state of the LED driving device. It is noted that, since the impedance of the impedance unit 40 of each first switching circuit 4 is much larger than that of each first resistor 6, the first current ($I_{31}$) is much greater than the second current ($I_{32}$) and the third currents ($I_{13}$, $I_{23}$).

Figure 6:
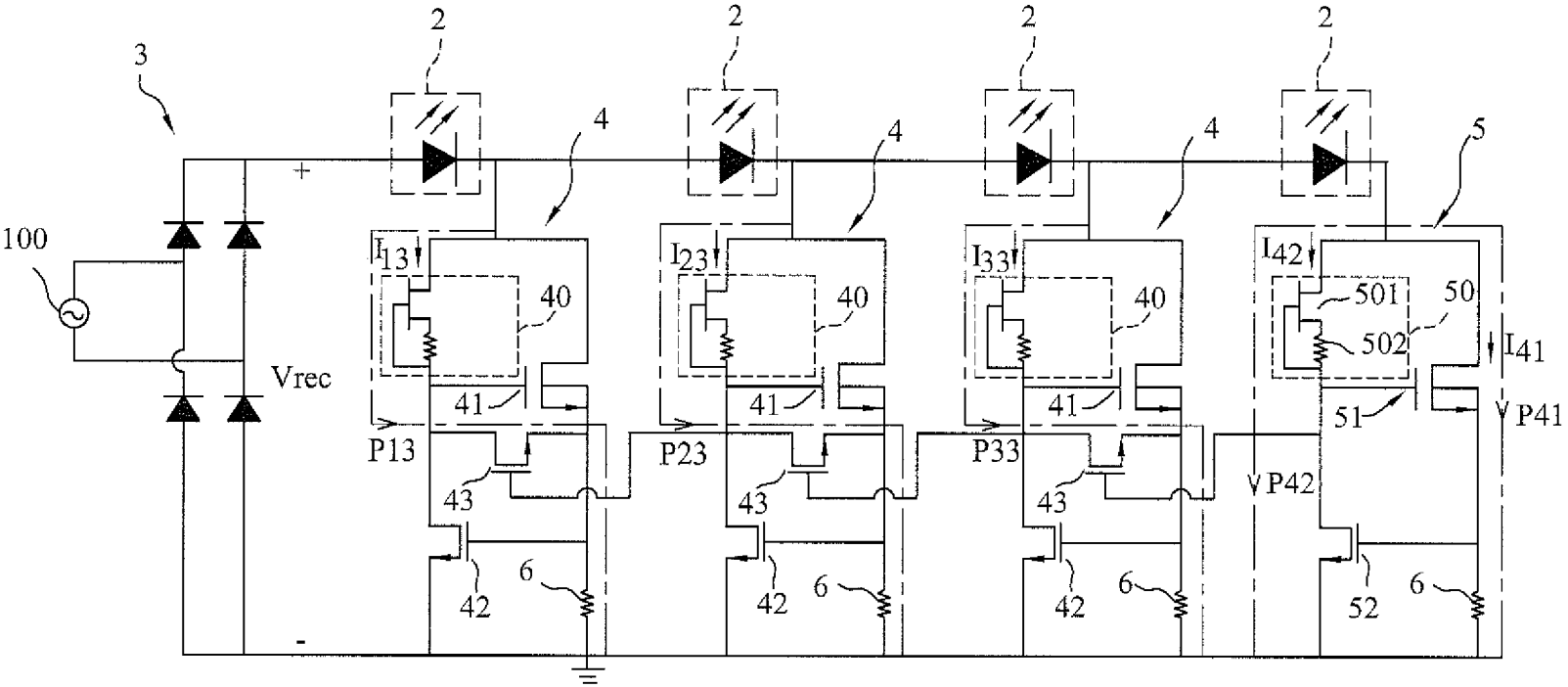

Referring to FIG. 6, when the DC voltage (Vrec) is sufficient to turn on all of the LED units 2, the LED driving device operates in the fourth driving state. In the fourth driving state, the first and second switches 51, 52 of the second switching circuit 5 conduct. In addition, the first and second switches 41, 42 of each of the first switching circuits 4 do not conduct, and the third switch 43 of the same conducts. Thus, the first switch 51 of the second switching circuit 5 and a fourth one of the first resistors 6 of the resistor unit constitute a first conductive path (P41). The impedance unit 50 and the second switch 52 of the second switching circuit 5 constitute a second conductive path (P42). Therefore, the output end of the fourth LED unit 2 is coupled to ground through the first and second conductive paths (P41, P42). Meanwhile, in addition to the third conductive paths (P13, P23) provided respectively for the first and second LED units 2, the impedance unit 40 and the third switch 43 of the third one of the first switching circuits 4 and the third one of the first resistors 6 constitute a further third conductive path (P33). Therefore, the output end of each of the first to third LED units 2 is coupled to ground through a respective one of the third conductive paths (P13, P23, P33). In this case, the first one of the first switching circuits 4 permits the third current ($I_{13}$) to flow from the output end of the first LED unit 2 to ground through the third conductive path (P13). The second one of the first switching circuits 4 permits the third current ($I_{23}$) to flow from the output end of the second LED unit 2 to ground through the third conductive path (P23). The third one of the first switching circuits 4 permits the third current ($I_{33}$) to flow from the output end of the third LED unit 2 to ground through the third conductive path (P33). The second switching circuit 5 permits a first current ($I_{41}$) to flow from the output end of the fourth LED unit 2 to ground through the first conductive path (P41), and permits a second current ($I_{42}$) to flow from the output end of the fourth LED unit 2 to ground through the second conductive path (P42). As a result, all of the LED units 2 are driven to emit light during the fourth driving state of the LED driving device. It is noted that, since the impedance of the impedance unit 40 of each first switching circuit 4 is much larger than that of each first resistor 6, the first current ($I_{41}$) is much greater than the second current ($I_{42}$) and the third currents ($I_{13}$, $I_{23}$, $I_{33}$).

Figure 7:
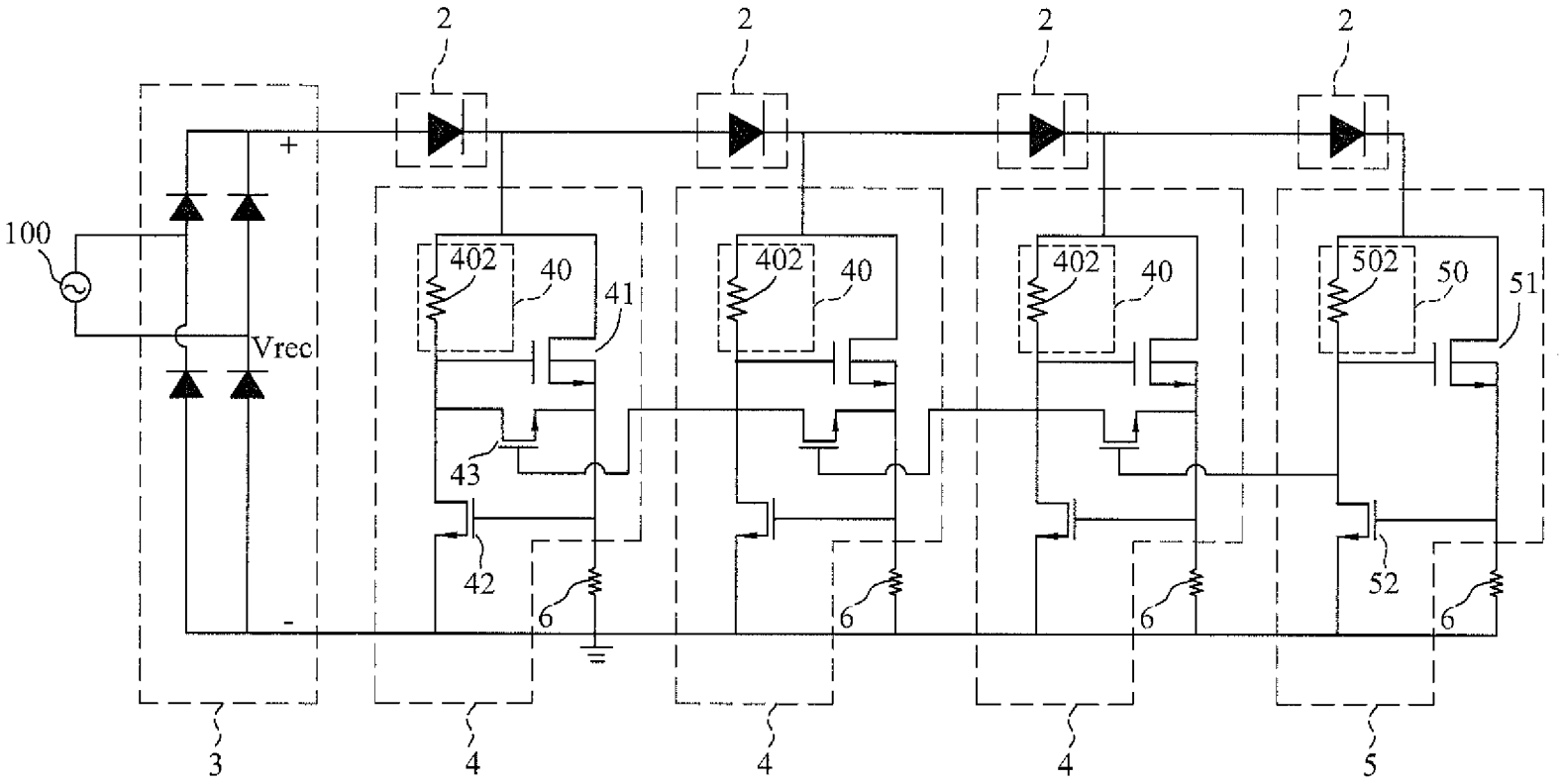
FIG. 7 is a schematic electrical circuit diagram illustrating the second preferred embodiment of an LED driving device according to the present invention.

FIG. 7 illustrates the second preferred embodiment of an LED driving device according to this invention, which is a modification of the first preferred embodiment. In this embodiment, the impedance unit 40, 50 of each of the first switching circuits 4 and the second switching circuit has only the second resistor 402, 502 coupled between the first and second ends thereof.

Figure 8:
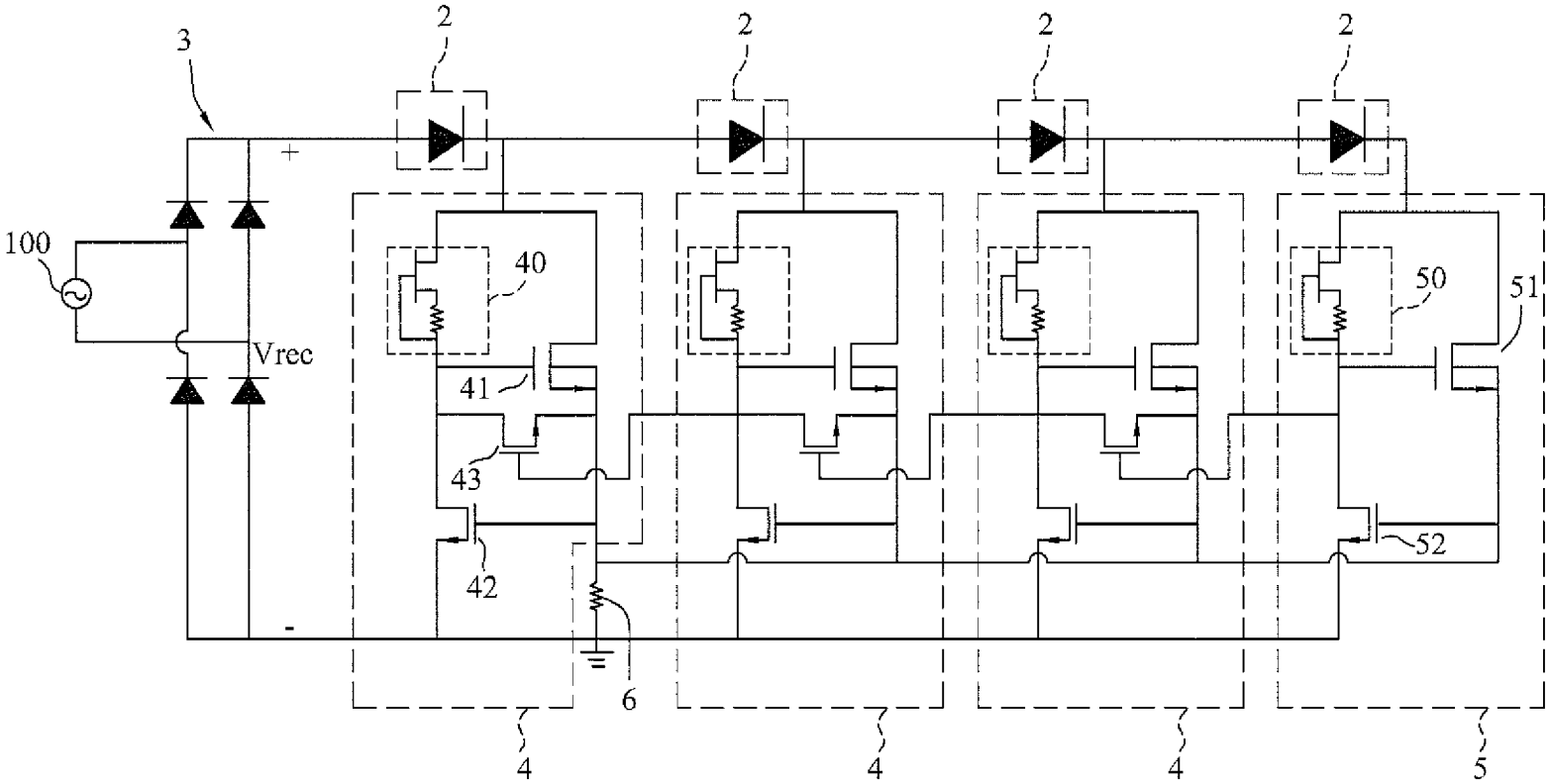
FIG. 8 is a schematic electrical circuit diagram illustrating the third preferred embodiment of an LED driving device according to the present invention.

FIG. 8 illustrates the third preferred embodiment of an LED driving device according to this invention, which is a modification of the first preferred embodiment. In this embodiment, the resistor unit has only one first resistor 6, which has one end coupled to the second end of the first switch 41, 51 of each of the first and second switching circuits 4, 5, and the other end coupled to ground.

Figure 9:
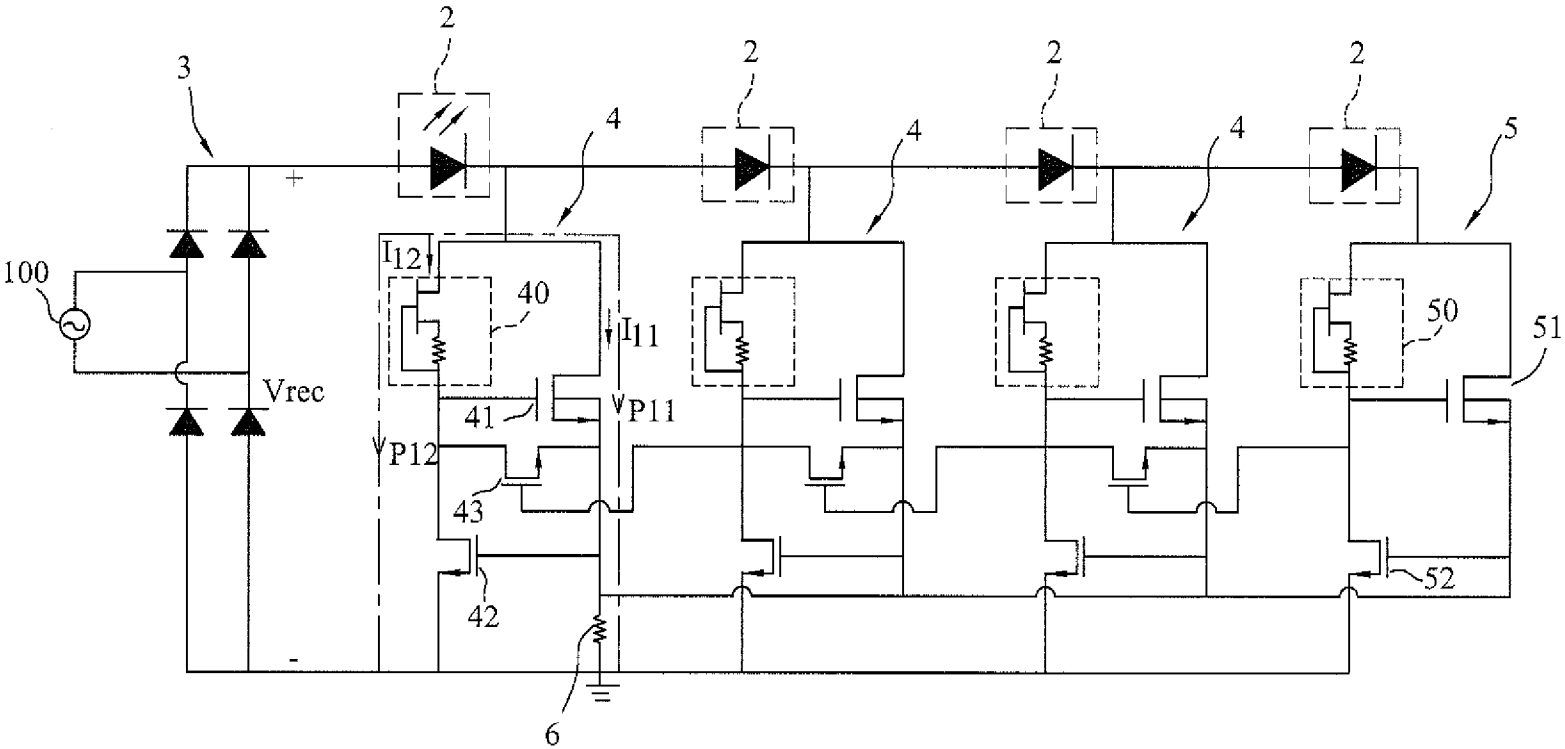
FIGS. 9 to 12 are schematic electrical circuit diagrams illustrating the third preferred embodiment when operating in first to fourth driving states, respectively.

Therefore, in the first driving state of the LED driving device, as shown in FIG. 9, the first switch 41 of the first one of the first switching circuits 4 and the first resistor 6 constitute the first conductive path (P11).

Figure 10:
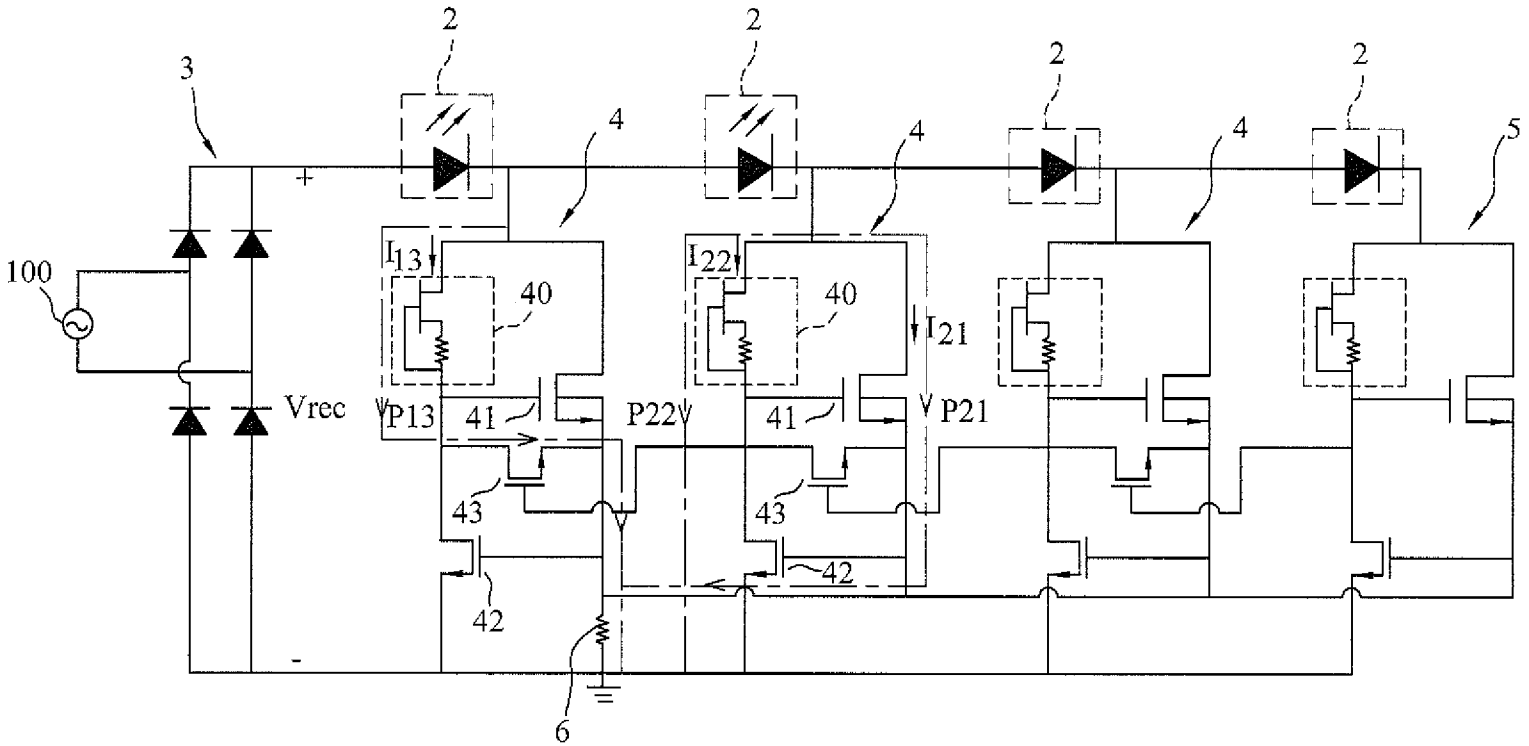

In the second driving state of the LED driving device, as shown in FIG. 10, the first switch 41 of the second one of the first switching circuits 4 and the first resistor 6 constitute the first conductive path (P21). The impedance unit 40 and the third switch 43 of the first one of the first switching circuits 4 and the first resistor 6 constitute the third conductive path (P13).

Figure 11:
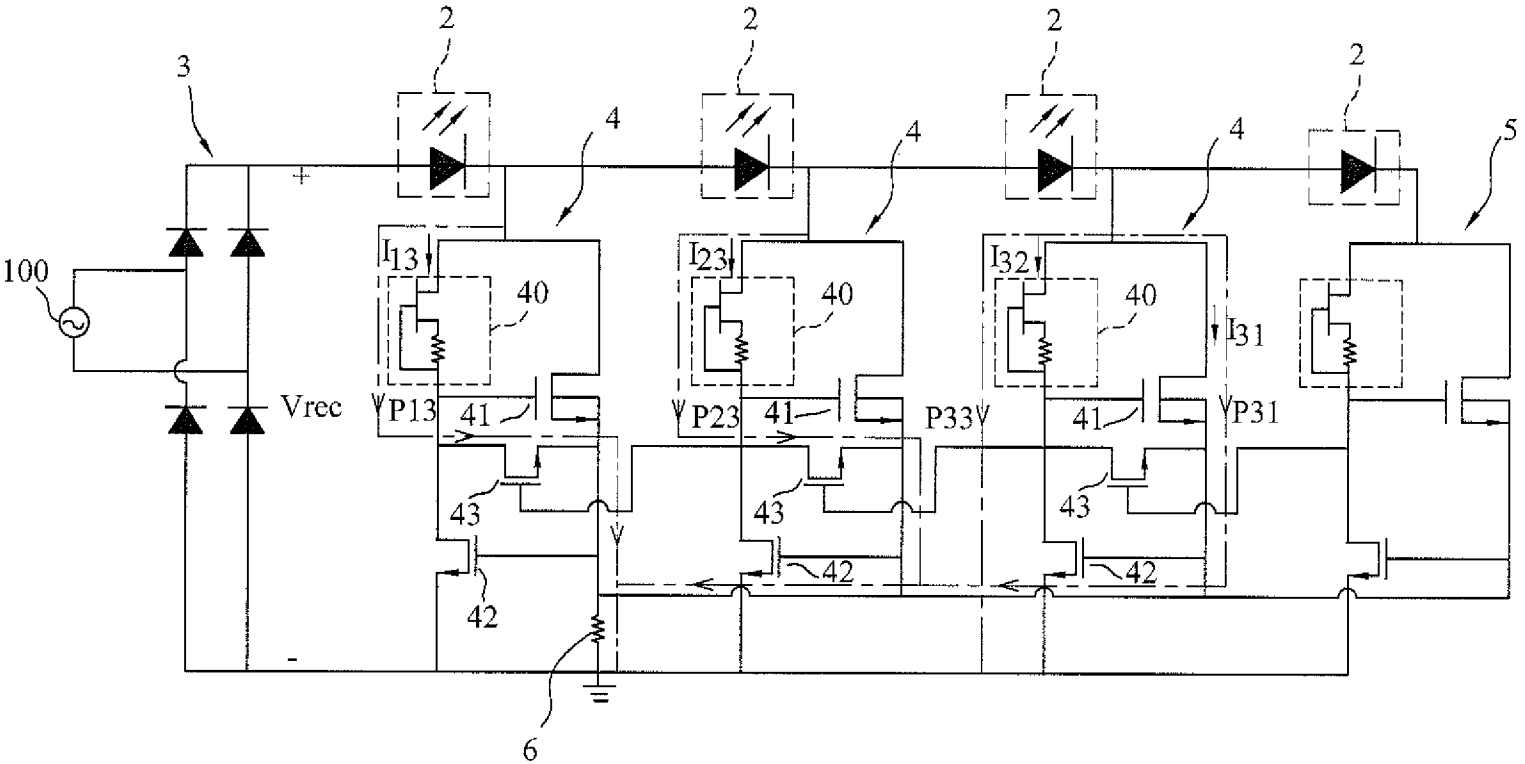

In the third driving state of the LED driving device, as shown in FIG. 11, the first switch 41 of the third one of the first switching circuits 4 and the first resistor 6 constitute the first conductive path (P31). The impedance unit 40 and the third switch 43 of each of the first and second ones of the first switching circuits 4, and the first resistor 6 constitute the third conductive path (P13, P23).

Figure 12:
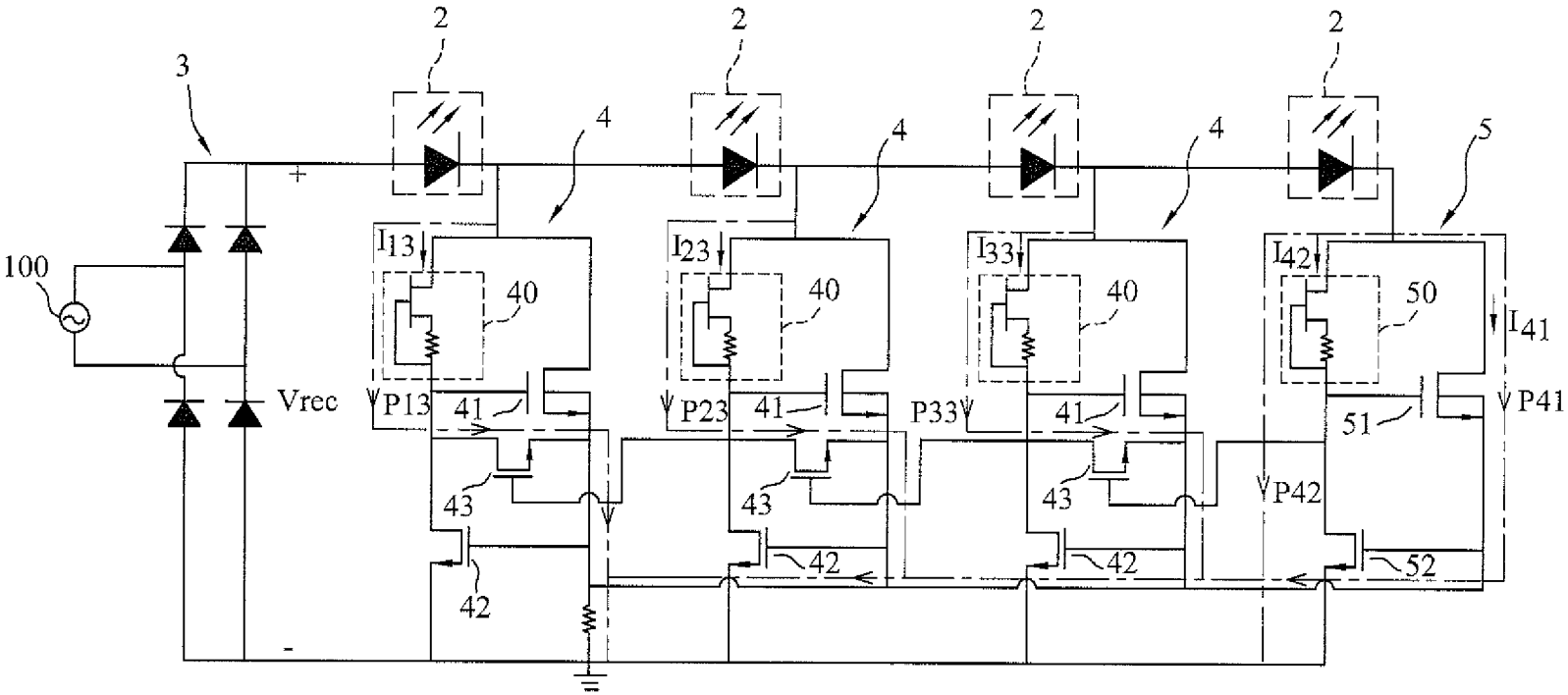

In the fourth driving state of the LED driving device, as shown in FIG. 12, the first switch 51 of the second switching circuit 5 and the first resistor 6 constitute the first conductive path (P41). The impedance unit 40 and the third switch 43 of each of the first switching circuits 4, and the first resistor 6 constitute the third conductive path (P13, P23, P33).

In view of the above, due to the first switching circuits 4 and the second switching circuit 5, the LED driving device can automatically switch among the first to fourth driving states in response to the DC voltage (Vrec) from the rectifying circuit 3 without the voltage generator 12 and the operational amplifiers (OP1~OP4) required by the conventional LED driving device 1 of FIG. 1. Therefore, the LED driving device of this invention has a relatively simple circuit configuration and a relatively low cost compared to the aforesaid conventional LED driving device 1. In addition, the LED driving device of this invention can be easily applied to the LED units 2 each including a desired number of LEDs with various types.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A light emitting diode (LED) driving device for driving a number (M) of LED units coupled in series, each of the LED units having an input end and an output end, said LED driving device comprising:

a rectifying circuit adapted to be coupled between an alternating current (AC) power source and the input end of a first one of the LED units for receiving an AC input voltage from the AC power source, said rectifying circuit rectifying the AC input voltage to a direct current (DC) voltage;

a number (M−1) of first switching circuits, each of which is adapted to be coupled between the output end of a corresponding one of first to $(M-1)^{th}$ ones of the LED units and ground;

a second switching circuit adapted to be coupled between the output end of an $M^{th}$ one of the LED units and ground; and a resistor unit coupled among said first switching circuits, said second switching circuit and ground;

wherein, when the DC voltage from said rectifying circuit is sufficient to turn on the first to $k^{th}$ ones of the LED units, in which k is a positive integer ranging from 1 to M, the output end of a $k^{th}$ one of the LED units is coupled to ground through first and second conductive paths, which are provided by a $k^{th}$ one of said first switching circuits and said resistor unit if $1 \le k \le M-1$, or by said second switching circuit and said resistor unit if k=M, and the output end of each of first to $(k-1)^{th}$ ones of the LED units is coupled to ground through a third conductive path, which is provided by a corresponding one of first to $(k-1)^{th}$ ones of said first switching circuits, and said resistor unit if $2 \le k \le M$.

2. The LED driving device as claimed in claim 1, wherein:

an $i^{th}$ one of said first switching circuits includes, where $1i \le M-1$, an impedance unit having a first end that is adapted to be coupled to the output end of an $i^{th}$ one of the LED units, and a second end, a first switch having a first end coupled to said first end of said impedance unit, a second end coupled to said resistor unit, and a control end coupled to said second end of said impedance unit, a second switch having a first end coupled to said second end of said impedance unit, a grounded second end, and a control end coupled to said second end of said first switch, and a third switch having a first end coupled to said second end of said impedance unit, a second end coupled to said second end of said first switch, and a control end coupled to said second end of said impedance unit of an $(i+1)^{th}$ one of said first switching circuits if $1 \le i \le M-2$;

said second switching circuit includes an impedance unit having a first end that is adapted to be coupled to the output end of the $M^{th}$ one of the LED units, and a second end that is coupled to said control end of said third switch of an $(M-1)^{th}$ one of said first switching circuits, a first switch having a first end coupled to said first end of said impedance unit of said second switching circuit, a second end coupled to said resistor unit, and a control end coupled to said second end of said impedance unit of said second switching circuit, and a second switch having a first end coupled to said second end of said impedance unit of said second switching circuit, a grounded second end, and a control end coupled to said second end of said first switch of said second switching circuit; and when the DC voltage from said rectifying circuit is sufficient to turn on the first to $k^{th}$ ones of the LED units, if $1 \le k \le M-1$, said first and second switches of the $k^{th}$ one of said first switching circuits conduct and said third switch of the $k^{th}$ one of said first switching circuits does not conduct such that said first switch of the $k^{th}$ one of said first switching circuits and said resistor unit constitute the first conductive path provided for the $k^{th}$ one of the LED units, and such that said impedance unit and said second switch of the $k^{th}$ one of said first switching circuits constitute the second conductive path provided for the $k^{th}$ one of the LED units, if $2 \le k \le M-1$, said first and second switches of each of the first to $(k-1)^{th}$ ones of said first switching circuits do not conduct and said third switch of each of the first to $(k-1)^{th}$ ones of said first switching circuits conducts such that said impedance unit and said third switch of each of the first to $(k-1)^{th}$ ones of said first switching circuits, and said resistor unit constitute the third conductive path provided for a corresponding one of first to $(k-1)^{th}$ ones of the LED units, and if k=M, said first and second switches of said second switching circuit conduct such that said first switch of said second switching circuit and said resistor unit constitute the first conductive path provided for the $M^{th}$ one of the LED units, and such that said impedance unit and said second switch of said second switching circuit constitute the second conductive path provided for the $M^{th}$ one of the LED units, and said first and second switches of each of said first switching circuits do not conduct and said third switch of each of said first switching circuits conducts such that said impedance unit and said third switch of each of said first switching circuits and said resistor unit constitute the third conductive path provided for a corresponding one of the first to $(M-1)^{th}$ ones of the LED units.

3. The LED driving device as claimed in claim 2, wherein:

said resistor unit includes a number (M) of first resistors, a $j^{th}$ one of which is coupled between said second end of said first switch of a $j^{th}$ one of said first switching circuits and ground if $1 \le j \le M-1$ or between said second end of said first switch of said second switching circuit and ground if j=M; and when the DC voltage from said rectifying circuit is sufficient to turn on the first to $k^{th}$ ones of the LED units, if $1 \le k \le M-1$, the $k^{th}$ one of said first switching circuits permits a first current to flow from the output end of the $k^{th}$ one of the LED units to ground through the first conductive path constituted by said first switch thereof and a $k^{th}$ one of said first resistors of said resistor unit, and permits a second current to flow from the output end of the $k^{th}$ one of the LED units to ground through the second conductive path provided by the $k^{th}$ one of said first switching circuits, if $2 \le k \le M-1$, each of the first to $(k-1)^{th}$ ones of said first switching circuits permits a third current to flow from the output end of the corresponding one of the first to $(k-1)^{th}$ ones of the LED units to ground through the third conductive path constituted by said impedance unit and said third switch thereof and a corresponding one of first to $(k-1)^{th}$ one of said first resistors of said resistor unit, and if k=M, said second switching circuit permits a first current to flow from the output end of the $M^{th}$ one of the LED units to ground through the first conductive path constituted by said first switch thereof and an $M^{th}$ one of said first resistors of said resistor unit, and permits a second current to flow from the output end of the $M^{th}$ one of the LED units to ground through the second conductive path provided by said second switching circuit, and each of said first switching circuits permits a third current to flow from the output end of the corresponding one of the first to $(M-1)^{th}$ ones of the LED units to ground through the third conductive path constituted by said impedance unit and said third switch thereof and a corresponding one of first to $(M-1)^{th}$ ones of said first resistors of said resistor unit.

4. The LED driving device as claimed in claim 3, wherein said impedance unit of each of said first switching circuits and said second switching circuit has an impedance much larger than that of each of said first resistors of said resistor unit, such that the first current in each of said first switching circuits and said second switching circuit is much greater than the second current in the corresponding one of said first switching circuits and said second switching circuit, and such that the first current in each of said first switching circuits is much larger than the third current in the corresponding one of said first switching circuits.

5. The LED driving device as claimed in claim 4, wherein, for each of said first switching circuits and said second switching circuit:

said impedance unit includes a transistor and a second resistor coupled to each other in series and coupled respectively to said first and second ends of said impedance unit, said transistor having a control end coupled to said second end of said impedance unit, said second resistor having a resistance much larger than that of each of said first resistors of said resistor unit.

6. The driving device as claimed in claim 5, wherein, for each of said first switching circuits and said second switching circuit:

said transistor of said impedance unit is an N-type junction field effect transistor (JFET), which has a drain serving as said first end of said impedance unit, a gate serving as said control end thereof, and a source, said second resistor having one end that is coupled to said source of said transistor, and the other end that serves as said second end of said impedance unit.

7. The LED driving device as claimed in claim 4, wherein, for each of said first switching circuits and said second switching circuit:

said impedance unit includes a second resistor coupled between said first and second ends thereof and having a resistance much larger than that of each of said first resistors of said resistor unit.

8. The LED driving device as claimed in claim 2, wherein:

wherein said resistor unit includes a first resistor, which has one end coupled to said second end of said first switch of each of said first switching circuits and said second switching circuit, and the other end coupled to ground; and when the DC voltage from said rectifying circuit is sufficient to turn on the first to $k^{th}$ ones of the LED units, if $1 \le k \le M-1$, the $k^{th}$ one of said first switching circuits permits a first current to flow from the output end of the $k^{th}$ one of the LED units to ground through the first conductive path constituted by said first switch thereof and said first resistor of said resistor unit, and permits a second current to flow from the output end of the $k^{th}$ one of the LED units to ground through the second conductive path provided by the $k^{th}$ one of said first switching circuits, if $2 \le k \le M-1$, each of the first to $(k-1)^{th}$ ones of said first switching circuits permits a third current to flow from the output end of the corresponding one of the first to $(k-1)^{th}$ ones of the LED units to ground through the third conductive path constituted by said impedance unit and said third switch thereof and said first resistor of said resistor unit, and if k=M, said second switching circuit permits a first current to flow from the output end of the $M^{th}$ one of the LED units to ground through the first conductive path constituted by said first switch thereof and said first resistor of said resistor unit, and permits a second current to flow from the output end of the $M^{th}$ one of the LED units to ground through the second conductive path provided by said second switching circuit, and each of said first switching circuits permits a third current to flow from the output end of the corresponding one of the first to $(M-1)^{th}$ ones of the LED units to ground through the third conductive path constituted by said impedance unit and said third switch thereof and said first resistor of said resistor unit.

9. The LED driving device as claimed in claim 8, wherein said impedance unit of each of said first switching circuits and said second switching circuit has an impedance much larger than that of said first resistor of said resistor unit, such that the first current in each of said first switching circuits and said second switching circuit is much greater than the second current in the corresponding one of said first switching circuits and said second switching circuit, and such that the first current in each of said first switching circuits is much larger than the third current in the corresponding one of said first switching circuits.

10. The LED driving device as claimed in claim 9, wherein, for each of said first switching circuits and said second switching circuit:

said impedance unit includes a transistor and a second resistor coupled to each other in series and coupled respectively to said first and second ends of said impedance unit, said transistor having a control end coupled to said second end of said impedance unit, said second resistor having a resistance much larger than that of said first resistor of said resistor unit.

11. The LED driving device as claimed in claim 2, wherein each of said first to third switches of each of said first switching circuits and said first and second switches of said second switching circuit is an N-type metal oxide semiconductor field effect transistor (MOSFET), which has a drain, a source and a gate serving respectively as said first, second and control ends thereof.

12. The LED driving device as claimed in claim 1, wherein said rectifying circuit includes a full-bridge rectifier.

* * * * *